US005483411A

United States Patent [19]

Sturman et al.

[11] Patent Number: 5,483,411

[45] Date of Patent: Jan. 9, 1996

[54] CHATTERLESS LOW POWER AC SOLENOID WITHOUT POLE SHADING

[76] Inventors: Oded E. Sturman, 3973 Santa Monica Ct., Newberry Park, Calif. 91320; Benjamin Grill, 9819 Etiwanda Ave., Northridge, Calif. 91325; Lynn Harrison, 23554 Cherry, Newhall, Calif. 91321; Edwin Hunter, P.O. Box 65, Rancho Santa Fe, Calif. 92067

[21] Appl. No.: 422,624

[22] Filed: Apr. 13, 1995

Related U.S. Application Data

[63] Continuation of Ser. No. 52,077, Apr. 22, 1993.

[51] Int. Cl.[6] ..... F15B 13/044

[52] U.S. Cl. ..... 361/160; 363/126; 335/257

[58] Field of Search ..... 323/292, 293, 323/352, 364; 361/160; 363/126; 307/317.1; 335/246, 247, 257

[56] References Cited

U.S. PATENT DOCUMENTS 3,628,102 12/1971 Jauch ..... 361/160
3,968,406 7/1976 Arnoux ..... 363/126
4,054,802 10/1977 Mock ..... 361/160
4,688,157 8/1987 Rischmueller ..... 363/126
5,076,326 12/1991 McCabe ..... 335/257

*Primary Examiner*—William M. Shoop, Jr.
*Assistant Examiner*—Peter Ganjoo
*Attorney, Agent, or Firm*—Blakely, Sokoloff, Taylor & Zafman

[57] ABSTRACT

A Chatterless AC Solenoid without pole shading is disclosed. The solenoid has a stationery member and a moveable member forming a magnetic circuit having a small but predetermined gap in the magnetic circuit when the moveable member is in the solenoid actuated position, and a much larger gap when the moving member is in the unactuated position. Both the stationery member and the moveable member are fabricated from a relatively soft magnetic material, with a coil associated with the stationery member providing a magnetizing force for the resulting magnetic circuit responsive to a current in the coil. A first diode in the energizing circuit provides halfwave rectification of the AC excitation voltage, with a second diode across the coil leads providing a conduction path for the portion of the excitation cycle during which the first diode is not conducting, thereby adequately sustaining the magnetizing current in the coil to maintain the solenoid latched until the coil is again reenergized by current flow through the first diode. Alternate embodiments and various features of the invention are disclosed.

1 Claim, 2 Drawing Sheets

CHATTERLESS LOW POWER AC SOLENOID WITHOUT POLE SHADING

This is a continuation of application Ser. No. 08/052,077 filed Apr. 22, 1993.

BACKGROUND OF THE INVENTION

1. Field of the Invention

The present invention relates to the field of solenoid actuators.

2. Prior Art

Solenoid actuators, particularly in the form of linear actuators, are very well known in the prior art in various forms and for various applications. Generally such actuators consist of a stationary magnetic member and a moveable magnetic member forming a magnetic circuit having a minimum reluctance when the moveable magnetic member is in the actuated position and a larger reluctance when the moveable member is in the unactuated or extended position. In that regard as used herein, the words moveable and stationary are used in a relative sense and are meant to include applications wherein the moveable member, as referred to herein, is fixed to some frame of reference and the stationary member moves with respect thereto, as well as applications wherein both members move with respect to some fixed reference.

Solenoid actuators may be of the latching type or the non-latching type. Latching actuators in general normally will actuate and latch in the actuated position mechanically or magnetically when power is applied, and will remain latched until power is again applied and/or applied and removed in the same or some altered form, causing the same to then unlatch. Non-latching actuators, on the other hand, normally remain actuated only so long as power is applied. In that regard, the present invention generally relates to the field of non-latching actuators, and accordingly latching actuators will not be further discussed herein.

Actuators of the non-latching type may be operated either from a DC power source or an AC power source. In the case of a true DC power source such as a car battery or the like, eddy currents are only induced in the magnetic material during turn on and turn off of the solenoid, and not during the steady state on or off conditions. Accordingly, the heating of the magnetic material in the stationary and moveable members is generally negligible because of the very low duty cycle of the switching conditions and accordingly both members may be fabricated of solid magnetic (and electrically conductive) materials of substantially whatever size may be appropriate for the application without using laminated structures or other provisions to minimize eddy current losses. In solenoids intended for AC operation however, substantial eddy currents can be generated in the electrically conductive magnetic materials of the stationary and moveable member, which heating in many cases would be excessive unless laminated structures are used, especially for the normally larger stationary members. In the case of relatively small AC solenoids, special structures, typically of sheet magnetic material, may avoid the need for lamination, though such structures are in general not suitable for solenoids having higher mechanical energy output capabilities.

Also in the case of AC solenoids, the voltage in the coil and thus the current through the coil is constantly swinging through plus and minus extremes. Since the flux in the magnetic circuit is normally proportional to the current in the coil (for a fixed magnetic gap), and the force is proportional to the square of the flux density between the stationary and the moveable member, the actuating force is highest at the current extremes and rapidly diminishes as the current diminishes on each cycle. The net result is that the magnetic holding force of the solenoid while actuated has an average value plus a time variation between zero and twice the average value at twice the frequency of the excitation. Thus AC solenoids will tend to hum at twice the excitation frequency (120 hertz for 60 hertz excitation) and will actually chatter by varying amounts if a return spring or other mean starts to pull the moveable member away from the stationary member during a portion of each cycle when the flux density and thus the holding force is too low to adequately overcome the spring or other mechanism. Thus unless a special provision is made therefore, an AC solenoid may loudly chatter at a frequency equal to twice the excitation frequence. Similarly a DC solenoid operated on AC power will chatter, and may overheat on AC power.

A typical method of avoiding chatter in prior art AC solenoids is to "shade" part of a pole face between the stationary and the moveable magnetic members. Such shading consists basically of dividing the pole face into two portions, one of which is provided with a relatively low resistance conductor therearound. The net effect of the shaded pole is that the change in flux therethrough induces a current in the conductor which opposes such change in flux, causing the AC flux through the shaded pole to lag the AC flux through the portion of the pole which is not shaded. Thus the total flux in the working gap between the stationary member and the moveable never goes to zero, one pole portion always having a substantial flux density whenever the other pole portion has a low or zero flux density. By proper design the zero magnetic force at twice the excitation frequency which would occur in an unshaded configuration can be raised to a minimum force level equal to or exceeding a spring or other force tending to separate the moveable member and the stationary member, thereby avoiding the chatter. Shading however does tend to increase the cost, the heat generated by an AC solenoid and the required size thereof.

Another method of avoiding chatter in AC solenoids is to rectify the AC voltage, typically by a fullwave rectifier, and to drive the solenoid coil with the rectified voltage. Still the coil voltage will go to zero twice per excitation cycle, and accordingly in such instances it is common to provide a storage capacitor on the output of the fullwave rectifier to maintain adequate coil current during periods of zero or near zero excitation voltage. In that regard, particularly when using a DC drive or a rectified AC drive for solenoid power, normally the minimum working gap between the stationary member and the moving member is kept relatively significant so that the retentivity of the magnetic components will not inadvertently retain sufficient field strength to keep the solenoid latched when the excitation is removed therefrom. While the fullwave rectifier and storage capacitor work well and do not really compromise the solenoid design, they add size and expense in themselves, with particularly the capacitor contributing to a reduced life and reliability of the system.

The purpose of the present invention is to maintain simplicity and small size in the design and construction of the solenoid while at the same time minimizing the drive circuitry therefor to still allow operation on an AC excitation without chatter or inadvertent latching of the solenoid.

BRIEF SUMMARY OF THE INVENTION

A Chatterless AC Solenoid without pole shading is disclosed. The solenoid has a stationery member and a moveable member forming a magnetic circuit having a small but predetermined gap in the magnetic circuit when the moveable member is in the solenoid actuated position, and a much larger gap when the moving member is in the unactuated position. Both the stationery member and the moveable member are fabricated from a relatively soft magnetic material, with a coil associated with the stationery member providing a magnetizing force for the resulting magnetic circuit responsive to a current in the coil. A first diode in the energizing circuit provides halfwave rectification of the AC excitation voltage, with a second diode across the coil leads providing a conduction path for the portion of the excitation cycle during which the first diode is not conducting, thereby adequately sustaining the magnetizing current in the coil to maintain the solenoid latched until the coil is again reenergized by current flow-through the first diode. Alternate embodiments and various features of the invention are disclosed.

DETAILED DESCRIPTION OF THE INVENTION

Figure 1:
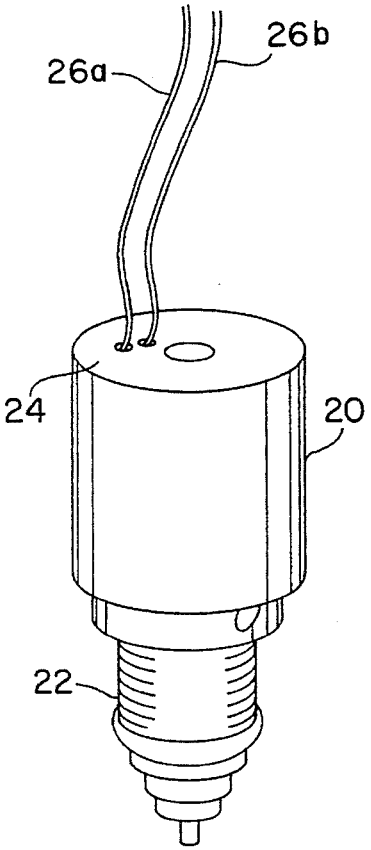
FIG. 1 is a perspective view of one embodiment of the present invention.

First referring to FIG. 1, a perspective view of one embodiment of the present invention may be seen. Since the AC solenoid of the present invention is adaptable to many applications, any specific configuration such as that shown in FIG. 1 will in general be adapted for the specific application, the embodiment shown being in the form of a pilot valve useful in any small direct flow applications and more particularly intended for use as part of a larger pilot valve operated apparatus.

The embodiment of FIG. 1 has a main housing within which the solenoid resides having adjacent the lower end thereof a threaded portion 22 for mounting the valve in a further assembly. Extending through a potted portion 24 at the top of the solenoid assembly are a pair of lead wires 26*a* and 26*b* for connecting the same to an AC power supply. Other aspects of the assembly shown in FIG. 1 are better illustrated in the cross section of FIG. 2, and accordingly will be described with respect to that figure.

Figure 2:
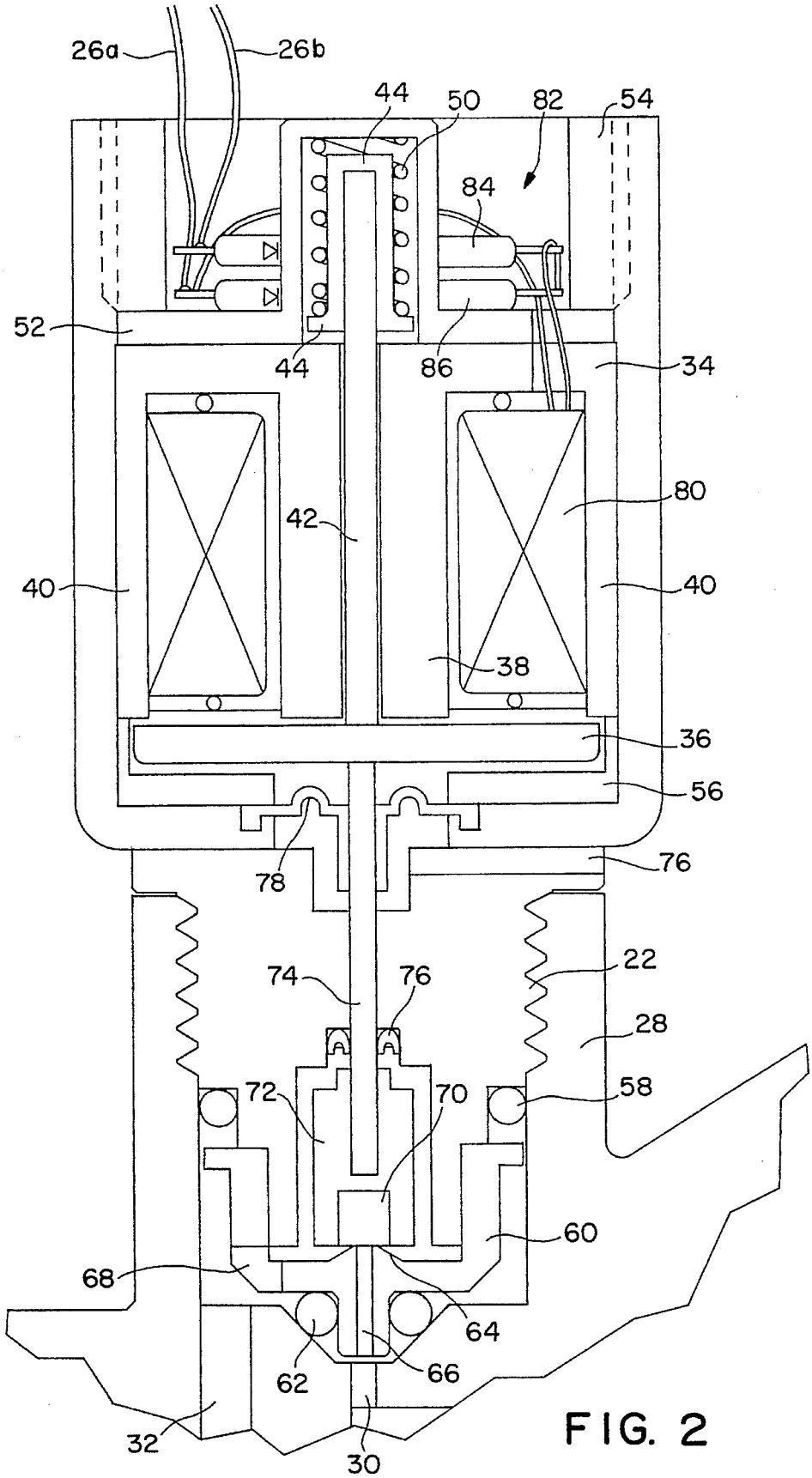
FIG. 2 is a partial cross section of the embodiment of FIG. 1.

As may be seen in FIG. 2, the assembly of FIG. 1 is threaded into a main valve body 28 of the pilot operated valve assembly, the body 28 having ports 30 and 32 for pilot valve flow as controlled by the solenoid of the present invention. The solenoid itself in the upper part of the body comprises a stationary magnetic member 34 and a moveable magnetic member 36. The stationary magnetic member 34 has a central circular integral pole 38 and an outer annular integral pole 40, with the moveable magnetic member 36 being in the form of a circular disk. The planar face of the central pole 38 is not coplanar with the planar face of the annular pole 40, but rather, in the embodiment shown, extends downward approximate to 0.005 inches less than the face of the annular pole 40. Thus when the solenoid is actuated (the solenoid being shown in FIG. 2 in the unactuated state), the moveable magnetic member 36 will be drawn upwards against the face of the annular pole 40, leaving approximately a 0.005 inch gap between the face of the moveable member 36 and the central pole 38 of the stationary magnetic member. The purpose of this gap will be subsequently described.

The central pole 38 has a hole therethrough within which a pin 42 may slide, the pin having a cap 44 on the upper end thereof with a preloaded coil spring 50 operating between top member 52 and a flange 54 on cap 44 to encourage the cap 44 and pin 42 and thus the moveable magnetic member downward unless or until the spring force is overcome by any magnetic forces between the stationary magnetic member 34 and the moveable magnetic member 36. The foregoing parts are retained in the body member 20 by an externally threaded member 54 threaded into cooperatively disposed threads at the upper inner end of the body member 20, member 56 providing space for the motion of the moveable magnetic member 36 between the actuated state when the moveable member is magnetically pulled upward against the face of the annular pole 40 of the stationary magnetic member and the furthermost travel allowed for the moveable magnetic member 36. In general, of the components hereinbefore described, in the preferred embodiment, only the stationary magnetic member and the moveable magnetic member are magnetic, though if desired spring 50 may also be magnetic as the same is sufficiently displaced when the magnetic circuit defined by stationary magnetic member 34 and moveable magnetic member 36 so as to not be significantly influenced thereby, though a nonmagnetic spring such as a beryllium copper spring may also be used. In general, in the preferred embodiment pin 42 is stainless steel, with the remainder of the parts, such as body 20, cap 44 and members 52, 54, and 56 being injection molded plastic members.

Also shown in FIG. 2 are the various aspects of the specific embodiment enabling the same to operate as a pilot valve. In particular, adjacent the lower end of body 20 is an O-ring 58 retained between the body member and the valve body 28 by a lower cap 60 sealed with respect to the body member 28 by O-ring 62 and providing the pilot valve seat 64 in communication with port 30 through port 66 in the cap. The cap is also ported through region 68 so that when the valve seat member 70 moves upwards therefrom, the pilot flow may take place through port 30, port 66 past the valve seat through region 68 and back through port 32, such flow being sealed off when the valve seat member 70 is against the valve seat 64 as shown in FIG. 2. The valve seat member 70 is retained by a valve seat retaining member 72 pressed on pin 74 which engages the bottom of the moveable magnetic member 36. Thus when the actuator is unlatched as shown, spring 50 forces pin 42 and the moveable magnetic member 36 downward, pin 74 also being forced downward by the movement of moveable magnetic member 36 to force valve seat member 70 against the pilot valve seat 64 to close the same. In the solenoid unactuated state, the limit of the downward motion of moveable magnetic member 36 is restricted by pin 74 as a result of the valve seat member 70 being forced against the valve seat 64 rather than by engagement with member 56 so that the spring 50 may hold the pilot valve closed. When the pilot valve is used with a pilot-operated valve for liquids, the chevron seal 76 prevents the liquid from leaking upward along pin 74, with any slight leakage which does occur being vented to the atmosphere through vent 76 in the body member 20. Leakage along pin 74 into the solenoid region is prevented by a diaphragm seal 78 sealing against pin 74 and between body member 20 and member 56.

Figure 3:
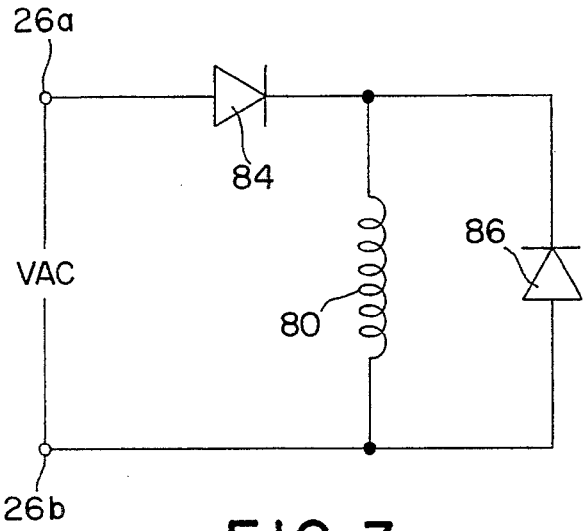
FIG. 3 is a circuit diagram of a drive circuit for the solenoid coil of the embodiment of FIGS. 1 and 2.

Located between the central pole piece 30 and the annular pole piece 40 of the stationary magnetic member 34 is a coil 80, the leads of which extend upward through a hole in the stationary magnetic member 34 to the region thereabove, generally indicated by the numeral 82. These two leads are connected to two diodes 84 and 86 in a manner to be described, with the ultimate connections to the circuit being made by leads 26*a* and 26*b*. The connection of coil 80 with diodes 84 and 86 and the solenoid leads 26*a* and 26*b* may be seen in FIG. 3. Diode 84 serves as a halfwave rectifier allowing voltage to be applied and current to flow through coil 80 in a first direction during one half cycle of the AC power signal, but blocking current flow through the diode in an opposite direction until the next half cycle of power of the same polarity. Diode 86, on the other hand, is connected directly across the two leads of coil 80 so as to form a loop therewith, diode 86 being oriented in polarity so as to allow current flow in the loop comprising coil 80 and diode 86 in the same direction through the coil as will be allowed by diode 84 from the AC power source.

Assume for the moment at time $T_O$ a voltage 88 is applied between leads 26*a* and 26*b*, lead 26*a* being assumed to be positive during the positive half cycle of the applied voltage. While the solenoid may be designed to operate on various voltages, assume for the moment that the voltage 88 is a 28 volt 60 hertz AC voltage. A specific embodiment in accordance with FIG. 2 has a housing outer diameter of approximately ⅞ inches and a length in the upper region thereof of approximately 1 inch. To prevent the device from inadvertently latching, the central pole 38 is specifically made approximately 0.005 inches shorter than the outer annular pole 40, with the movement of the moveable magnetic member 36 between the actuated and unactuated positions being approximately 0.015 inches. Obviously, the minimum of air gap achieved in the embodiment shown by making the central pole shorter than the outer annular pole which can be used without inadvertent latching will depend upon the material from which the magnetic members are fabricated, though in general some minimum non-magnetic gap should be maintained even if very soft magnetic materials are used, as even very soft magnetic materials may retain a substantial flux density in a zero air gap magnetic circuit. As shall subsequently be seen, it is desirable in the present invention to keep a relatively small minimum air gap and accordingly preferably relatively soft magnetic materials should be used for the magnetic members.

With the foregoing parameters, the air gap in the magnetic circuit when the solenoid is actuated will be approximately 0.005 inches, and when the solenoid is unactuated, approximately 0.035 inches. Since the flux in an air gap is directly proportional to the ampere turns in the coil divided by the air gap in the magnetic circuit, and the force on the moveable member 36 urging the same to the actuated position will be proportional to the square of the flux, it is obvious that a much higher current is required to actuate the solenoid with an effective air gap of 0.035 inches, assuming a reasonable preload on spring 50, than is required to maintain the solenoid in the actuated position with an effective air gap of 0.005 inches. Also, it is apparent that the inductance of the coil will be much higher when the solenoid is actuated than when it is unactuated, approximately by the inverse ratio of the air gaps under these two conditions. Finally, in a relatively small solenoid, typical actuation times are on the order of 0.01 seconds.

When the solenoid actuator is to be actuated, AC power is applied to the leads 26*a* and 26*b* (See FIG. 1). At this moment, the inductance of the solenoid coil is at a minimum because of the moveable member being initially at the solenoid unactuated position. Accordingly, during the half cycle of AC power when diode 84 is forward biased (See FIG. 3), current rapidly builds up in coil 80, and when the magnetic force on the moveable member overcomes the force of spring 50, the moveable member starts accelerating to the actuated position. For a small solenoid, full or nearly full actuation of the solenoid may occur in the one half cycle of the 60 hertz AC power. Even if full actuation is not completed in the half cycle, the moveable member will be rapidly approaching the stationary member and the inductance of the coil will be approaching its greatest value, so that when diode 84 stops conducting the back EMF of the coil forward biases diode 86 so that current continues to flow through the solenoid coil 80, at least until the next half cycle of the AC power of the same polarity as the cycle which initiated current flow through the solenoid coil.

Figure 4:
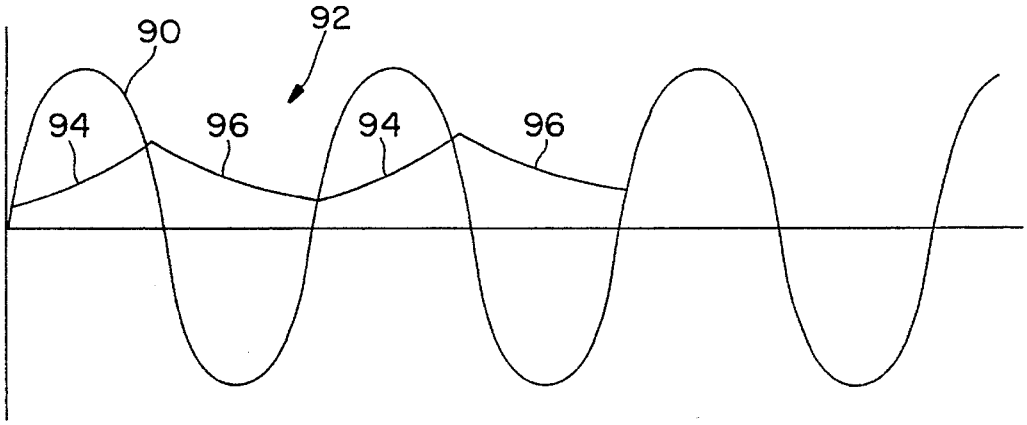
FIG. 4 is a diagram showing the waveforms for the AC input voltage and the current waveforms for the current in the solenoid coil as a result thereof.

In the steady state actuated condition, the applied voltage and current waveforms will be as shown in FIG. 4. There the AC voltage waveform 90 is shown, together with the current waveform generally indicated by the numeral 92. This current waveform of course assumes that conduction occurs during the positive half cycle of the AC voltage input. As shown, the current waveform segment 94 shows an increasing current in the coil so long as diode 84 is forward biased, the current thereafter decaying in segment 96 until diode 84 again becomes forward biased. Thus as shown therein, current through the portion of the applied power for which diode 84 is back biased is sustained at a decaying rate through diode 86 by the back EMF of the coil 80, with the current being maintained at at least a significant level at its minimum to maintain a substantial flux in the magnetic circuit to maintain the solenoid latched. In that regard, it should be noted again that the magnetizing force required to maintain the solenoid latched is much less than the magnetizing force required to initially actuate the solenoid because of the gross differences between the initial air gap (0.035 inches in this example) and the latched air gap (0.005 inches in this example). From an analytical viewpoint, during the portion of the cycle that diode 84 is conducting, the following equation applies:

$$V_{in} - V_D = iR + L\frac{di}{dt}$$

Where $V_{in}$ is the instantaneous AC voltage, i is the current, R is the coil resistance, L the coil inductance and $V_D$ the forward bias voltage drop of diode 84 (and in the subsequent equation, diode 86).

During the portion of the cycle when diode 84 is back biased and diode 86 is forward biased, the following equation applies:

$$L\frac{di}{dt} = -V_D - iR$$

It can be seen from the foregoing equation that during the time that diode 84 is back biased, the current is decreasing with time, and to the extent that $V_D$ is negligible compared to the other voltages in the circuit, the current is decreasing exponentially with time. Thus it can be seen from FIG. 4 that while latched, the average current in the coil is relatively low. In particular it will be noted that the coil current is driven by the power supply for less than one half cycle of the power supply, and then decays for something over one half cycle time before again being driven, so that the decay time actually exceeds the drive time. Thus the steady state power dissipated by the solenoid due to the $i^2R$ loss therein is also relatively low. In comparison, if a storage capacitor were used in place of diode 86, such capacitor would be substantially larger than the diode, and as mentioned before, would have a lower life and reliability. Further, the capacitor would charge to the peak voltage of the respective halfwave power supply, decaying from there until recharged by the next half cycle of the same polarity. This in essence substantially increases the average drive voltage to the coil, requiring more turns of finer wire to limit the current through the coil and the heat dissipated therein (i.e. for appropriate impedance matching). This too is less desirable as finer wire tends to be more difficult to wind, less reliable, makes less efficient use of the winding space because of the higher ratio of insulation to copper and the lower fill factor, and takes longer because of the increased number of turns required. Also it can be shown that in the halfwave rectifiers used in conjunction with the storage capacitor, the cyclical charging of the capacitor occurs over a time period of less than one fourth of a cycle of the AC power, whereas as can be seen in FIG. 4, the drive from the power supply to the circuit (current segment 94) is spread out over a time period somewhat less than one half of a cycle of the power source, thereby substantially more evenly drawing power from the power source. In the case of fullwave rectification the drive current through the solenoid coil will be more uniform than with halfwave systems, but in general will be higher on average in comparison to the initial coil current during the initial half cycle of solenoid drive power, resulting in greater power dissipation in the solenoid during steady state operation relative to the initial half cycle actuation current of the solenoid than is achieved with the present invention.

Thus is may be seen that the present invention has numerous advantages over prior art and other alternative systems. Such advantages include a high initial actuation current during the first half cycle of power, automatically followed by a substantially lower average current and thus substantially lower average power during steady state actuation of the solenoid. This lower steady state power allows the use of a smaller solenoid than would otherwise be allowed, as well as the operation thereof at lower temperatures, thereby increasing in solenoid reliability as a natural consequence thereof. Obviously while the present invention has been disclosed and described with respect to one specific embodiment of solenoid, namely a solenoid adapted for use as a pilot valve, it will be obvious to those skilled in the art that various changes in form and detail may be made therein without departing from the spirit and scope of the invention.

What is claimed is:

1. A fluid valve that receives AC power through a first power lead and a second power lead, comprising:

a housing that has an inlet port and an outlet port;

a valve that controls fluid communication between said inlet port and said outlet port;

a stationary magnetic member and a moveable magnetic member, each having a limited retentivity and together defining a magnetic circuit, said moveable magnetic member being moveable relative to said stationary magnetic member between a first retracted position and a second extended position, said moveable magnetic member being magnetically attracted toward said first retracted position when a magnetic field is in said magnetic circuit, said stationary magnetic member has a first pole area that extends from a core an amount greater than a second pole area of said stationary magnetic member, wherein said first pole area comes into contact with a first portion of said moveable magnetic member while a second portion of said moveable magnetic member is separated from said second pole area by a non-magnetic gap;

a coil having first and second leads and being disposed relative to said stationary and moveable magnetic members to cause a magnetic field in said magnetic circuit responsive to current in said coil;

a first diode coupled between the first power lead and said first coil lead, the second power lead being coupled to said second coil lead, said first diode allows current to flow from the AC source of power coupled to the first and second power leads through said coil in a first direction and not through said coil in a second direction opposite said first direction;

a second diode coupled between said first and second coil leads current to flow in a loop through said second diode and through said coil in a first direction and back through said second diode, and for blocking current flow in an opposite direction through said second diode;

means for encouraging said moveable member to said extended position.

* * * * *